United States Patent [19]

Kohler et al.

[11] Patent Number: 4,697,542

[45] Date of Patent: Oct. 6, 1987

[54] ADJUSTABLE NOZZLE FOR COATING EQUIPMENT

[75] Inventors: Herbert B. Kohler, Greentown; John B. Kohler, Canton, both of Ohio

[73] Assignee: The Kohler Coating Machinery Corporation, Greentown, Ohio

[21] Appl. No.: 4,229

[22] Filed: Jan. 2, 1987

Related U.S. Application Data

[63] Continuation of Ser. No. 732,924, May 13, 1985, abandoned.

[51] Int. Cl.[4] ..... B05C 11/06

[52] U.S. Cl. ..... 118/63; 15/306 A

[58] Field of Search ..... 118/63, 410, 413; 15/306 A, 415 A

[56] References Cited

U.S. PATENT DOCUMENTS

| | | | |
|---|---|---|---|
| 3,314,163 | 4/1967 | Kohler | 118/63 X |
| 3,605,687 | 9/1971 | Russell | 118/262 |
| 4,169,425 | 10/1979 | Wohrle | 118/126 X |
| 4,359,964 | 11/1982 | Johnson | 118/63 |
| 4,405,661 | 9/1983 | Alheid | 118/413 X |
| 4,512,279 | 4/1983 | Damrau et al. | 118/413 X |
| 4,534,309 | 8/1985 | Damrau et al. | 118/413 X |

*Primary Examiner*—John P. McIntosh

*Attorney, Agent, or Firm*—Pearne, Gordon, McCoy & Granger

[57] ABSTRACT

A fluid nozzle for use in coating a traveling web has an elongated nozzle body formed by a first rigid boxlike section having a pair of converging walls and a second less rigid section pivotally mounted on the first section. A pair of lips are mounted on the nozzle body sections and define a nozzle opening through which fluid is discharged from a fluid chamber formed within the first body section and directed against the web. One of the lips is mounted on one of the converging body walls and the other lip is mounted on a support plate forming part of the second body section for adjusting the size of the fluid discharge opening. The support plate and attached nozzle lip of the second section are pivotally moved with respect to the first section by a plurality of levers which are moved in unison by pressure actuated cylinders or by two continuous pressure actuated tubes mounted between the support plate and nozzle body. The cylinders or tubes move the pivotally mounted lip away from the other lip to increase the size of the discharge opening for cleaning the nozzle lips and return the lips to the coating position without requiring any change to the lip settings. One or more spaced adjustment wedges also may be slidably mounted between the nozzle body wall and slide plate for adjusting the size of the discharge opening while the nozzle is "on line". The pair of nozzle body sections are provided with mating surfaces which are clampingly engaged when in the coating position.

22 Claims, 14 Drawing Figures

FIG. 4
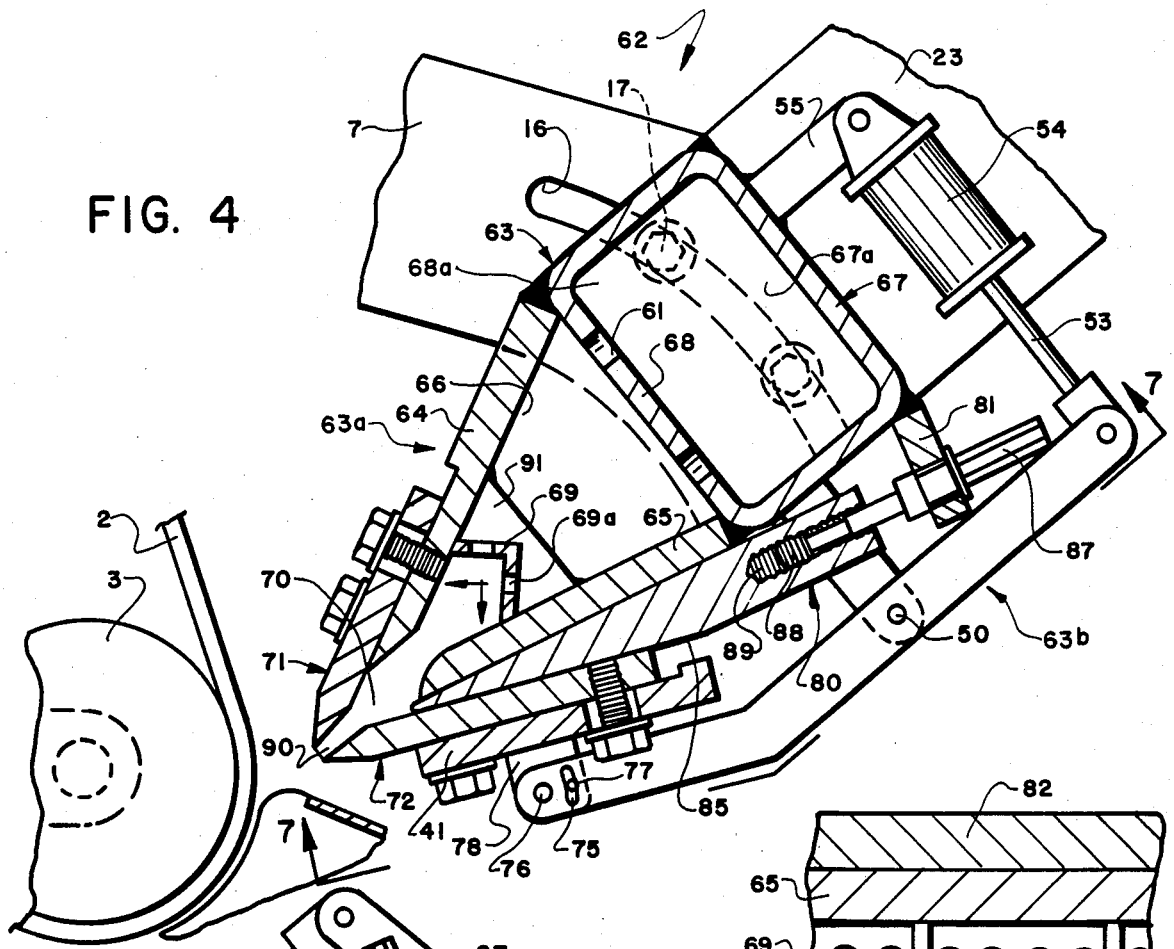
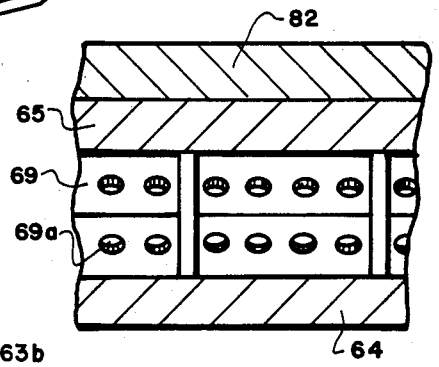
FIG. 6
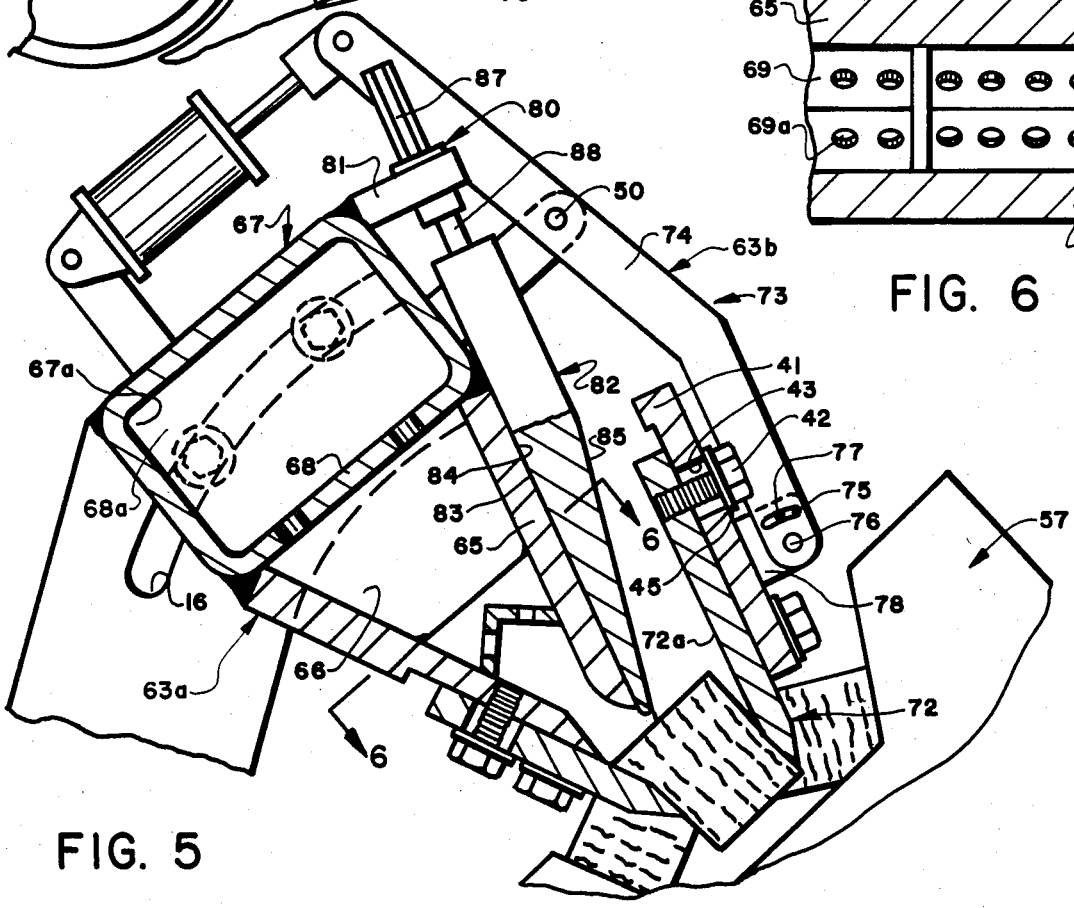
FIG. 5

FIG. 8
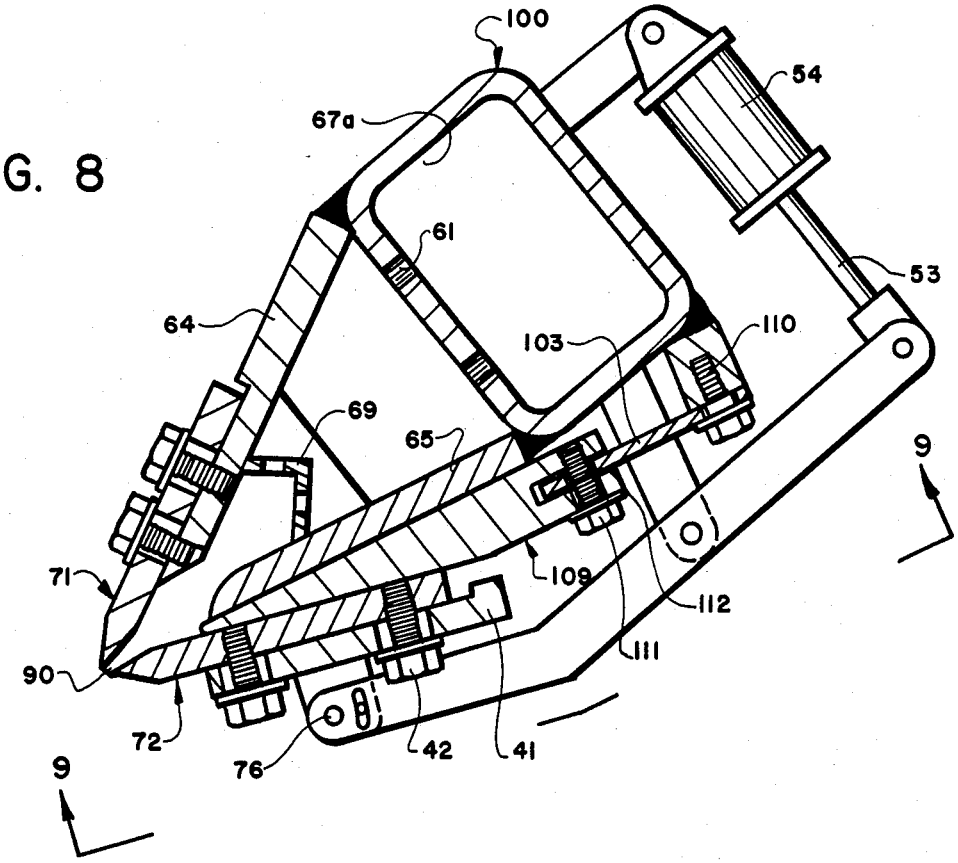
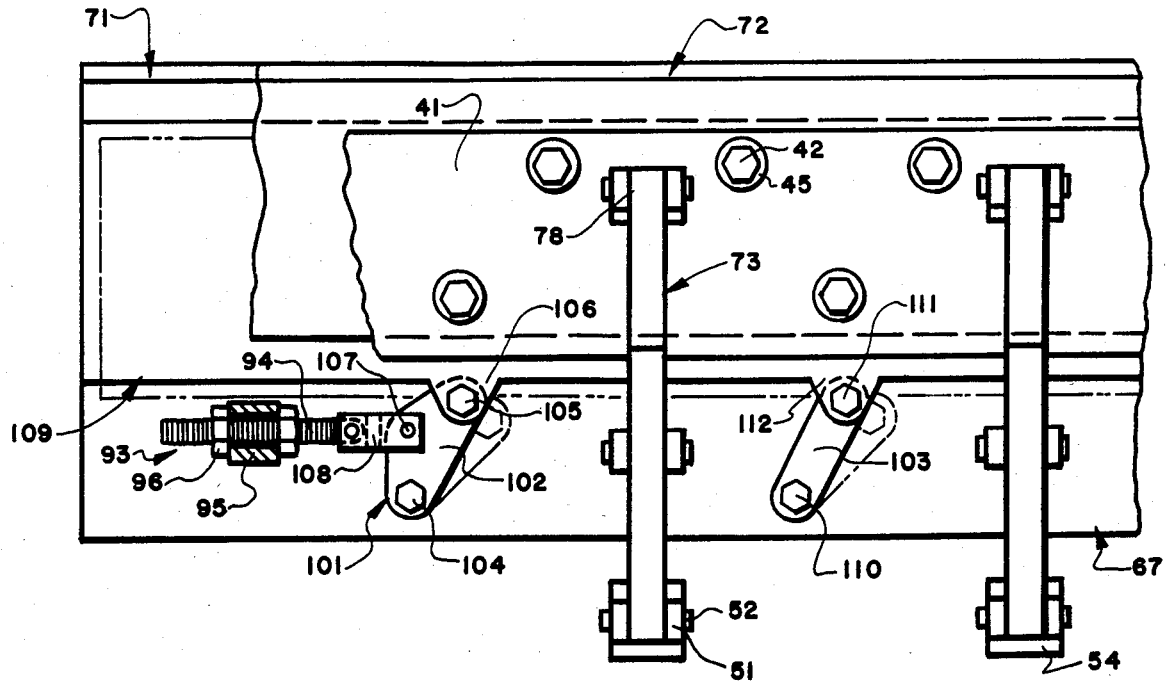
FIG. 9

FIG. 10
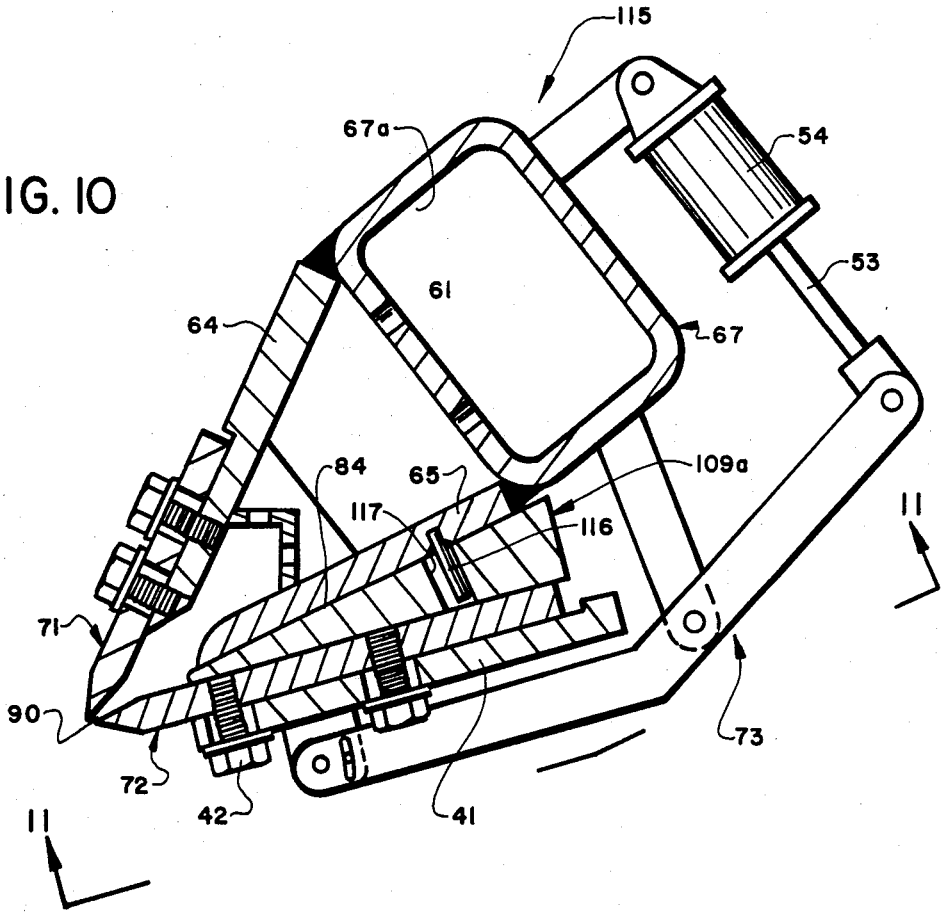
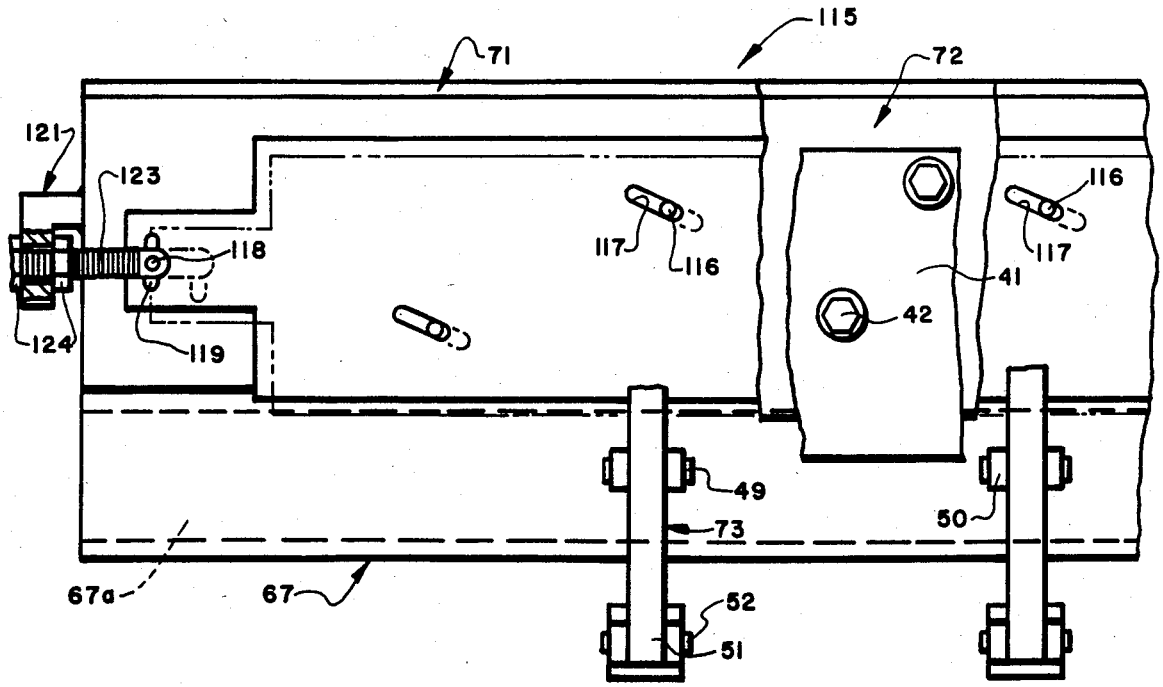
FIG. 11

FIG. 12
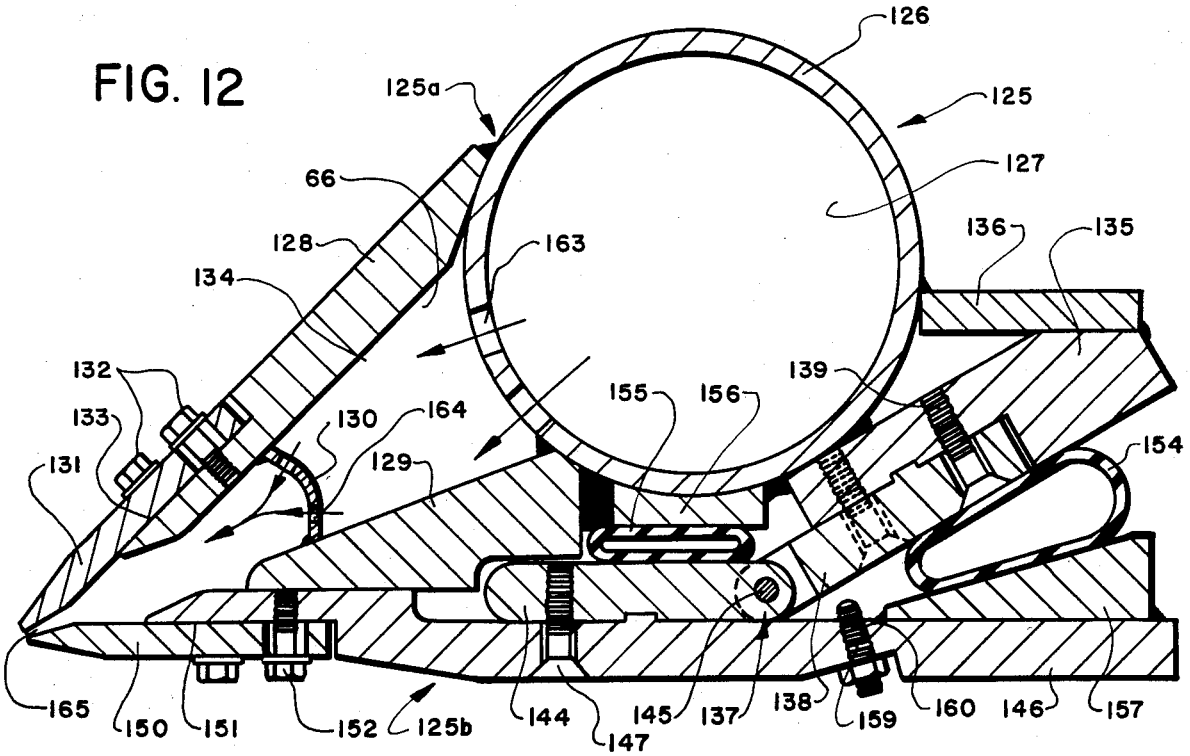
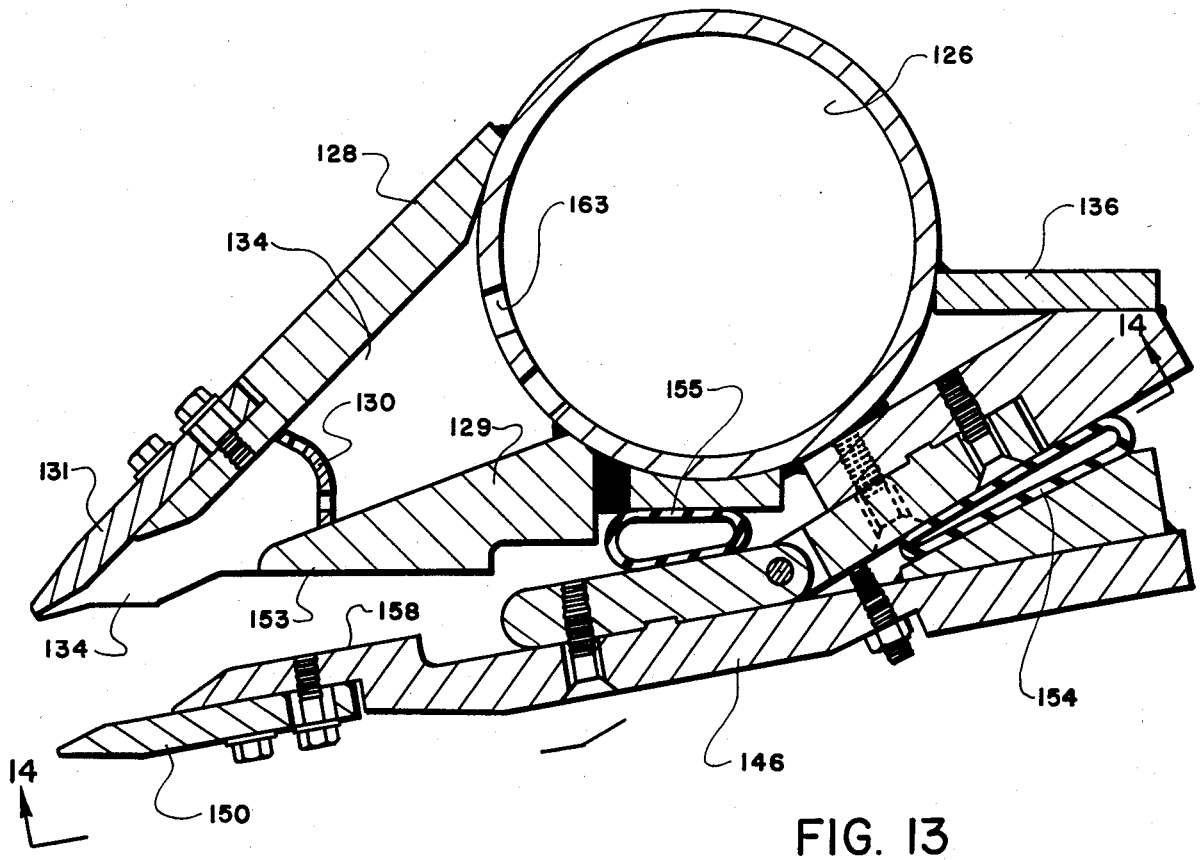
FIG. 13

ADJUSTABLE NOZZLE FOR COATING EQUIPMENT

This is a continuation of application Ser. No. 732,924 filed on May 13, 1985 now abandoned.

TECHNICAL FIELD

This invention relates to improvements in nozzle constructions of coating machines and the like. More specifically, the invention relates to a fluid nozzle, which can be opened for cleaning and which has improved means for moving one of the nozzle lips to an open position and back to a coating position without affecting a preset discharge opening, and in which the moveable lip is securely clamped against and supported for its full transverse length by the main nozzle body structure when at the coating position. Furthermore, the invention relates to such an improved nozzle in which the nozzle discharge opening can be adjusted along the length of the nozzle while the nozzle is "on line", without changing the present mounting position of the lips.

BACKGROUND ART

Gaseous fluid nozzles have been used in the coating industry for at least two basic functions, the first of which may be classified as "doctoring means". In this use, the jet of gaseous fluid issuing from the nozzle impinges on a substrate, which has immediately before been coated in excess, to reduce and smooth the coating to the required standards as the substrate passes the nozzle.

Another basic use of gaseous fluid nozzles is in the strip processing industry as a "backing means", in which case, the jet is applied to one side of the moving strip, such as paper or plastic film, to maintain a uniform pressure against an object on the opposite side, such as a cooling roll or a rigid coating knife. One example of the "backing means" use is illustrated in the U.S. Pat. No. 3,113,884.

It is not intended to limit the principles of the present invention to the paper coating industry or the coating of substrates of this general type, but rather it is fully contemplated that the principles of the present invention may be applied to nozzles for many uses, some of which may not be presently known.

In most uses, it is important that the nozzle opening be uniform within close limits throughout the entire transverse length of the nozzle opening to insure a uniform coating on the moving substrate throughout its width. This can be a problem in many fluid nozzles due to the lack of stiffness in the transverse length of the lips forming the nozzle opening, or in the supporting nozzle body to which the lips are attached. Variations in the nozzle opening cause variations in the force output of the jet which produce variations in the coating thickness left on the strip.

In certain cases, it is desirable to be able to "contour" the nozzle opening, and in these cases, conformity to the desired shape is equally important. It is also extremely important in the coating industry that downtime and scrap be kept to a minimum. Since the coating station is usually only one part of a complicated and expensive system which provides a high rate of production, such as a paper board machine, or a steel galvanizing line, faults such as dirt in the nozzle produce scrap rapidly while stops disrupt many processes, and restarting after a stop may take many minutes, and produce much off standard product due to such disruption. A speck of dirt on or in the nozzle opening can cause a streak in a 200 inch wide strip running 1000 feet per minute or more. Since the nozzle usually has a convergent throat, particles which are too large to pass through the final orifice often lodge in the throat. The opening feature makes it easy to rid the nozzle of such blockages, saving lost time and lost production.

With the improved nozzle of this invention, dirt and streak problems can be corrected in seconds if dirt is loose, or a slightly longer period if the dirt is sticky and scrubbing is required. When the nozzle is restored to service, all settings and adjustments remain unchaged from the previous condition.

Many problems of existing nozzles have been eliminated by the improved nozzles of U.S. Pat. Nos. 3,314,163 and 4,513,915. However, use of the opening feature of these nozzle designs has been limited by the relatively high costs of their construction when compared with nonopening style nozzles, and also by the fact that constructing the nozzle in two sections requires that each section be large and stiff enough to provide a stable support for the nozzle lip attached thereto, so the resulting size alone makes it impossible to fit this type of nozzle into many coaters. In these "two support structure" nozzles, each half deflects outward between loading and control points, so the change in nozzle opening due to deflection between closure loading and control points is equal to the sum of the deflections of both halves. For these reasons, the advantages of the opening style have frequently been sacrificed, and non-opening nozzles containing the internal air distribution arrangement of U.S. Pat. No. 3,314,163, have frequently been furnished as a substitute by the assignee of these patents. In these non-opening style nozzles, the structures of the nozzles include a transversely extending tubular body with transversely extending lip mounting plates welded thereto, and transversely extending perforated metal walls welded between said plates, all of which provide a box-like structure giving stiffening reinforcement to the entire structure. This gives the nozzle a rigid, stable, relatively nondeformable structure.

Lip seats are carefully machined on the lip mounting plates, and thin rather flexible carefully ground lips which form the nozzle orifice or fluid discharge opening are solidly bolted thereto, using closely spaced bolts in slotted holes formed in the lips. The lips are flexible enough to allow deformation during placement for accurate alignment of the lips, and for adjustment of the nozzle opening between them. The setting of such lips in these non-opening nozzles and the corresponding opening therebetween, can be performed by a skilled mechanic using special tools, in twenty to sixty minutes. Lips when so set by bolting to the rigid structure, are sufficiently stable so that any necessity for readjustment is extremely rare unless a damaged lip must be replaced,or the size of the discharge opening must be changed.

An alternative, older, non-opening style nozzle construction consists of a U-shaped nozzle body of sufficiently heavy cross section to avoid appreciable deformation due to internal pressure, with the lip seats formed in the "U" extensions. Such nozzles have given satisfactory service, particularly in small transverse lengths, where the end plates tieing the two ends of the "U" shape together are close enough to effect stiffness of the complete structure.

One other known type of fluid nozzle construction having a pivotally mounted discharge opening forming lip is shown in U.S. Pat. No. 4,359,964. The fluid nozzle construction of this patent provides an adjustable nozzle opening by pivotally mounting the nozzle lip on an adjustable toggle linkage which moves the lip toward and away from a second fixed lip to provide access into the nozzle interior for cleaning. One disadvantage of a nozzle following the teachings of this patent lies in the fact that the lip is free to rotate about the groove in the nozzle body which is its only rigid point of support, and this arcuate motion in limited only by a relatively unstable adjustable toggle linkage which has passed over center. The distance the toggle pin can pass center would also be limited by the lips coming together when the toggle passes center. Therefore, if the user of a nozzle similar to that shown in this patent tries to set an orifice of, for example, 0.030", and the design has the proportions as shown in the structure of the patent, the distance of the pivot below center would be limited to approximately 0.030", hardly enough for stability.

Also, the stop mechanism of prior nozzles as shown in U.S. Pat. No. 4,359,964 would have to be arranged to stop the downward motion of the pivot before it travels 0.030" below the straight line through centers. Without such a stop, the device would allow the lip to continue to open under the influence of the interal fluid pressure in the nozzle, and the construction would no longer limit the orifice height. A further disadvantage of such a nozzle is that the pivoted lip throughout its length and width from the pivot location to the orifice is subject to the entire pressure of the internal fluid within the nozzle. This makes it extremely difficult to control the amount of deflection along the transverse length of the lip, thereby vastly increasing the difficulty of maintaining the desired discharge opening uniformly throughout the nozzle transverse length.

Therefore, the need has existed for a fluid nozzle in which one of the nozzle discharge opening lips can be lifted away from the other to open the nozzle for cleaning, but when in operating position is clamped tightly against and is stiffened by the entire nozzle structure; in which the movable lip can be returned upon reclosing to the exact previous setting of the discharge opening; and in which air pressure within the nozzle acts only on a limited area of each lip, thus minimizing the bending of the lip along an axis parallel to its transverse length; since such bending increases the height of the discharge opening. There is also, but not always, a need for such a nozzle in which the height of the discharge opening at all points across its transverse length can be adjusted while in operating position by a single adjustment, or can be shaped by segmental adjustments.

DISCLOSURE OF THE INVENTION

Objectives of the invention include providing an improved fluid jet nozzle construction for coating control equipment, of the type in which the nozzle is built in two parts and hinged together so that it may be opened for inspection or cleaning, and arranged so that the hinge pivots, closure application points, and closure stops are dispersed across the transverse length of the nozzle close enough to neutralize the separating force of the internal pressure, in order to reduce the deflection of the nozzle structure caused by the internal pressure between said points below measurable valves. A furthur objective is to provide such a construction in which one of the nozzle parts is relatively rigid and stiff, while the other is relatively flexible, and each part has a flat surface throughout its transverse length which mates with the other when the nozzle is closed in working position, so that application of adequate closure pressure distributed across the transverse length causes the more flexible part to conform to the deflected form of the more rigid part, and ensures clamping action across the entire transverse length.

Another objective of the invention is to provide such a nozzle construction in which each part of the nozzle terminates in one of a pair of orifice defining lips mounted thereon, which lips are attached by bolts passing through slots allowing their locations to be adjusted during mounting with the aid of removable jacking devices so each may be set in correct relationship to the other to produce an orifice of exact form square with the line of the jet, and in which both lips then can be clamped semi-permanently in place by tightening the clamping bolts. A still further objective is to provide such a nozzle with internal chambering to compartment the main body into a transverse feed chamber, an equalizing chamber, and a plenum, whereby the chamber walls strengthen and stiffen the main portion of the nozzle thereby increasing the stiffness of the nozzle.

A further objective of the invention is to provide such a nozzle having communicating holes between compartments in such a manner that fluid flow through the holes is directed toward surfaces of the nozzle structure to ensure complete intermingling; in which the discharge orifice opening can be adjusted uniformly across the transverse length of the nozzle with a single adjustment; in which means are provided for selectively and controllably varying the shape of the nozzle opening, as for tapering the opening in galvanizing; and in which the outer surfaces are unobstructed so that the secondary air flow toward the orifice is smooth and laminar.

Another objective is to provide such an improved nozzle in which one of the lips is slidably adjustably mounted by bolts on a moveable plate, which plate is mounted on the ends of one or more spaced lever assemblies controlled by pressure actuated cylinders for pivotally moving the nozzle lip away from the other nozzle lip enabling a cleaning mechanism to be inserted therebetween; and in which the lever assemblies will return the pivotally mounted nozzle lip to its adjusted coating position without requiring any readjustment or setting changes.

Another objective of the invention is to provide an improved nozzle construction in which the lever assemblies for movably mounting one of the nozzle lips are replaced by a continuous plate on which the movable lip is mounted, and in which the heretofore pressure actuated cylinders are replaced by two inflatable tubes extending continuously throughout the length of the nozzle for opening and closing the nozzle discharge opening. Still another objective is to provide such a nozzle in which one of the lips is adjustably mounted on a slide plate that is pivotally mounted by a piano type hinge on the nozzle body and moved between open and closed positions by the pair of inflatable tubes, and in which the support plate and lip are sufficiently flexible relative to the nozzle body, so that the pressure in the inflatable tube which closes the nozzle can deform the plate and lip to conform to any deflection of the main nozzle body.

A still further objective of the invention is to provide such a nozzle construction in which one or more wedge blocks are slidably mounted between one of the nozzle walls and the pivotally mounted nozzle lip whereby the size of the nozzle discharge opening may be adjusted at one or more locations along the length while the nozzle is "on line".

Another objective of the invention is to provide such an improved nozzle in which an increase in internal fluid pressure will have little effect on the nozzle opening and deflection thereof since the lip supporting surfaces of the nozzle body are rigidly interconnected, and only a small portion of the lip outside the body is exposed to the internal pressure.

A further objective is to provide such a nozzle which provides the advantages of an opening style nozzle with a less expensive construction such as that provided by non-opening nozzles; and in which the improved nozzle eliminates difficulties existing in the art, solves existing problems, satisfies needs and obtains new results.

These objectives and advantages are obtained by the improved nozzle construction of the invention, the general nature of which may be stated as including a transversely elongated nozzle body having a rigid first section with a pair of converging walls partially forming a fluid pressure chamber; a second section pivotally mounted on the first section; first and second nozzle lips mounted on the first and second sections, respectively, with the first lip being mounted on one of the converging walls; said lips completing the formation of the fluid pressure chamber and forming and defining the size of a discharge opening for discharging a transversely elongated jet of fluid against a moving strip of material; mating surfaces formed on each of the two sections for clamping engagement with each other when the lips are in a coating position; and pressure exerting means disposed across the transverse length of the nozzle body and mounted on the first section and acting on the second section for clamping the two mating surfaces together to define the size of the discharge opening when the nozzle lips are in a clamped coating position and for moving the second lip to a retracted position away from the first lip a sufficient distance for cleaning said nozzle lips.

PREFERRED EMBODIMENTS OF THE INVENTION

Preferred embodiments of the invention, illustrative of the best mode in which applicants have contemplated applying the principles, are set forth in the following description and shown in the drawings and are particularly and distinctly pointed out and set forth in the appended claims.

FIG. 4 is a view similar to FIG. 1 showing a modified form of the improved adjustable coating nozzle in coating position located adjacent a traveling web with the nozzle being shown partially in section;

FIG. 5 is a view of the modified coating nozzle of FIG. 4 moved to a retracted cleaning position with the nozzle lips being engaged with a cleaning mechanism;

FIG. 6 is a fragmentary sectional view taken on line 6—6, FIG. 5;

FIG. 8 is a view similar to FIG. 4 showing a further modified form of the improved adjustable coating nozzle shown partly in section;

FIG. 9 is a fragmentary view with portions broken away and in section, looking in the direction of arrows 9—9, FIG. 8;

FIG. 10 is a view similar to FIGS. 4 and 8 showing another modified form of the improved nozzle;

FIG. 11 is a fragmentary view with portions broken away looking in the direction of arrows 11—11, FIG. 10;

FIG. 12 is a sectional view similar to FIGS. 1, 4, 8 and 10 showing a further modified form of the improved adjustable coating nozzle;

FIG. 13 is a view similar to FIG. 12 with the nozzle being shown in an open cleaning position.

Similar numerals refer to similar parts throughout the drawings.

BEST MODE FOR CARRYING OUT THE INVENTION

First Embodiment

Figure 1:
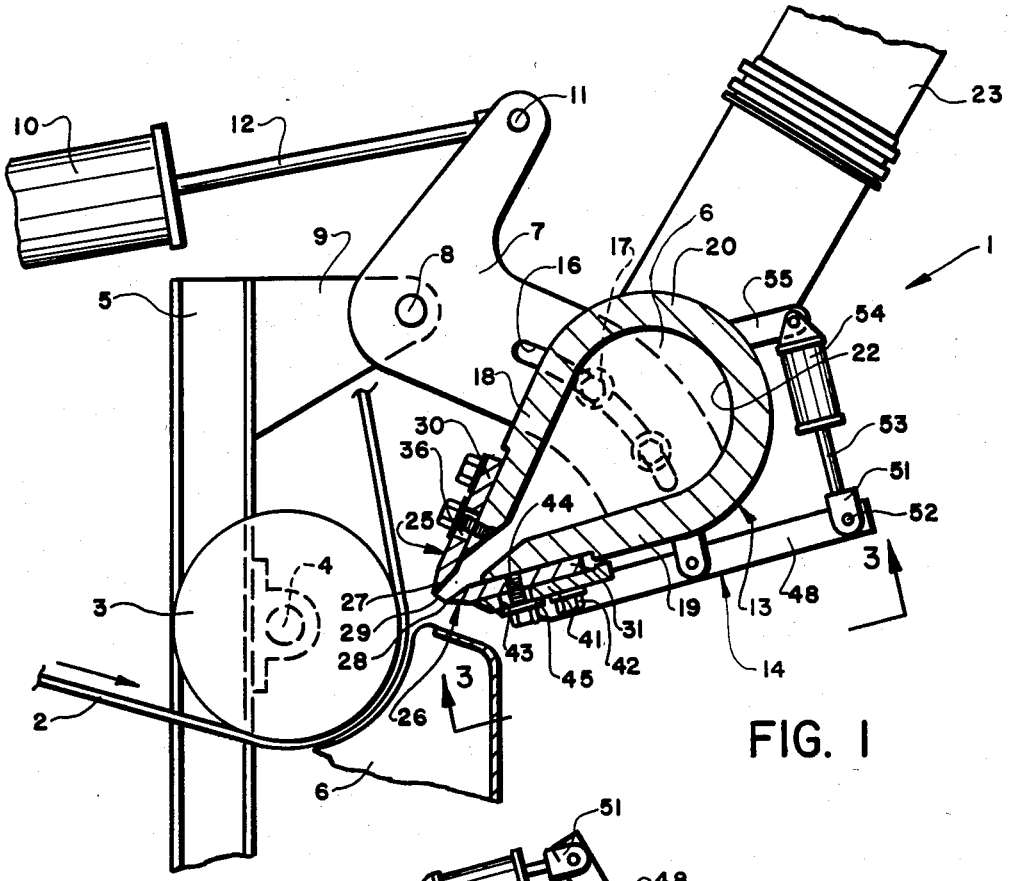
FIG. 1 illustrates the improved adjustable coating nozzle shown partially in section and located adjacent a moving web which extends about a backup roll with the nozzle being in coating position.
Figure 2:
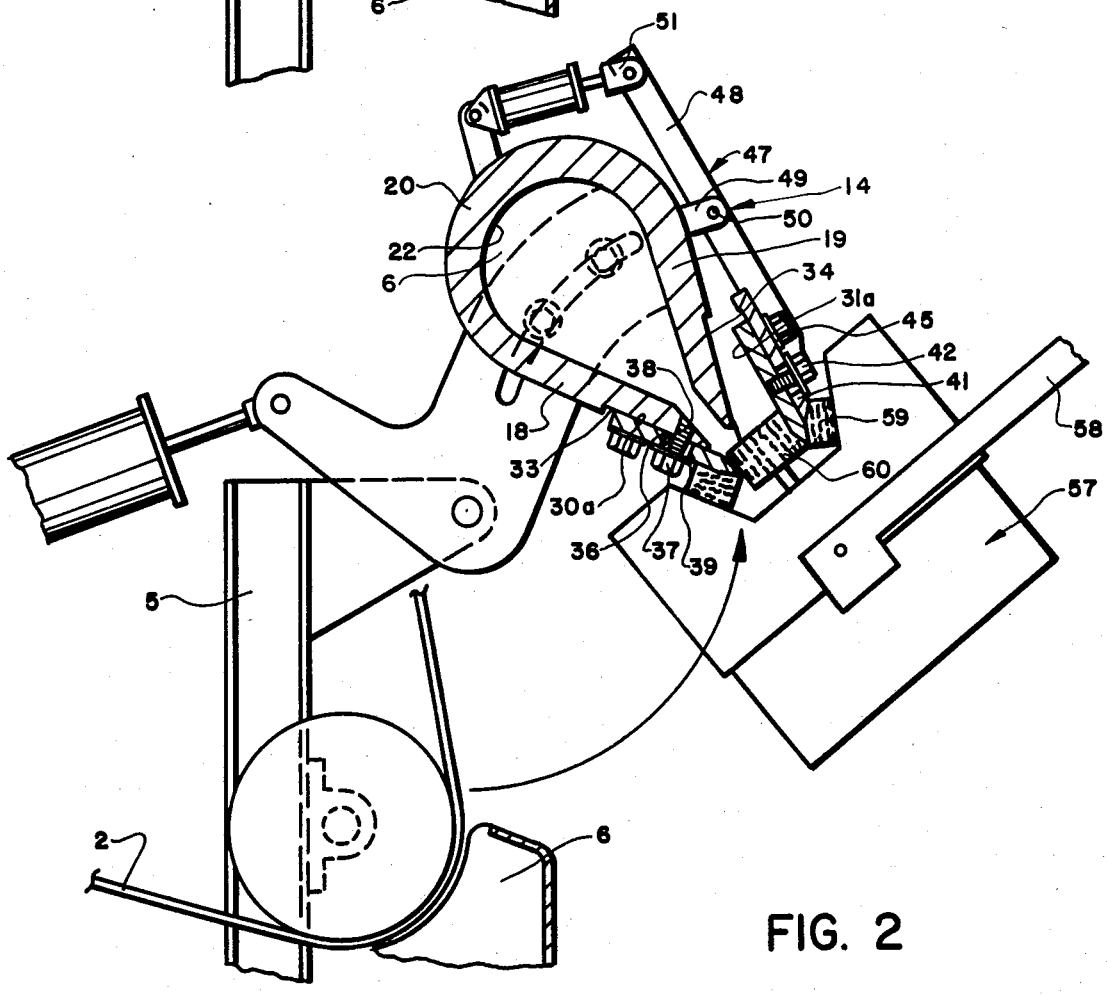
FIG. 2 is a view similar to FIG. 1 showing the adjustable coating nozzle in a retracted cleaning position with a cleaning mechanism cleaning the nozzle lips.
Figure 3:
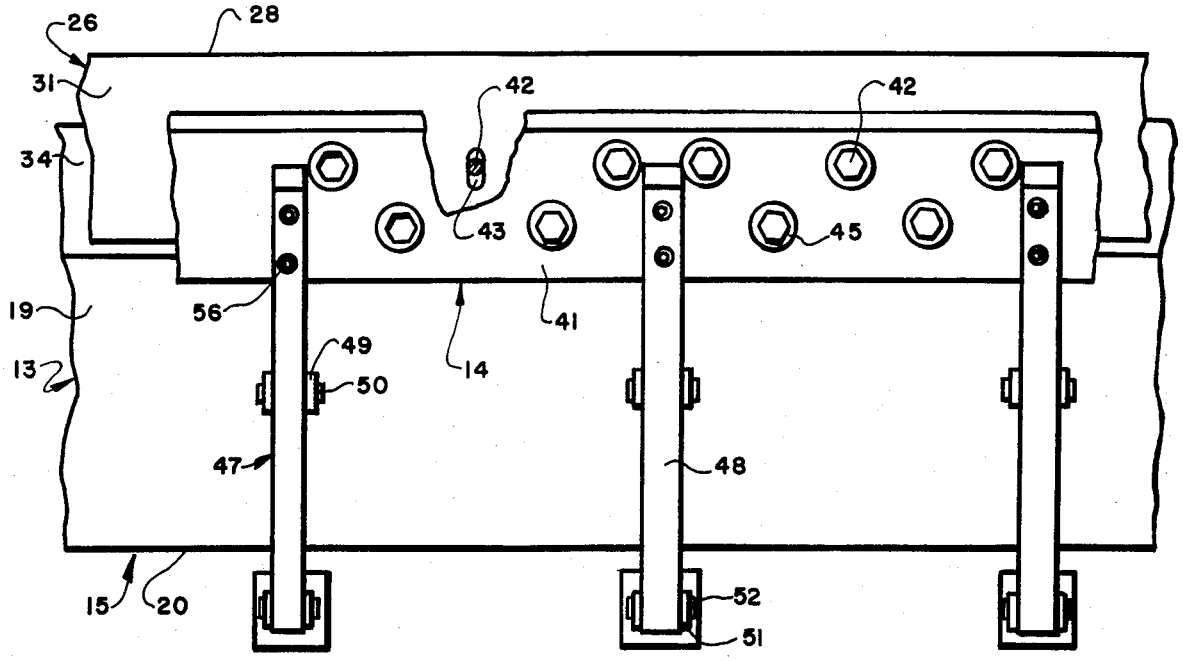
FIG. 3 is a fragmentary plan view with portions broken away looking in the direction of arrows 3—3, FIG. 1.
Figure 7:
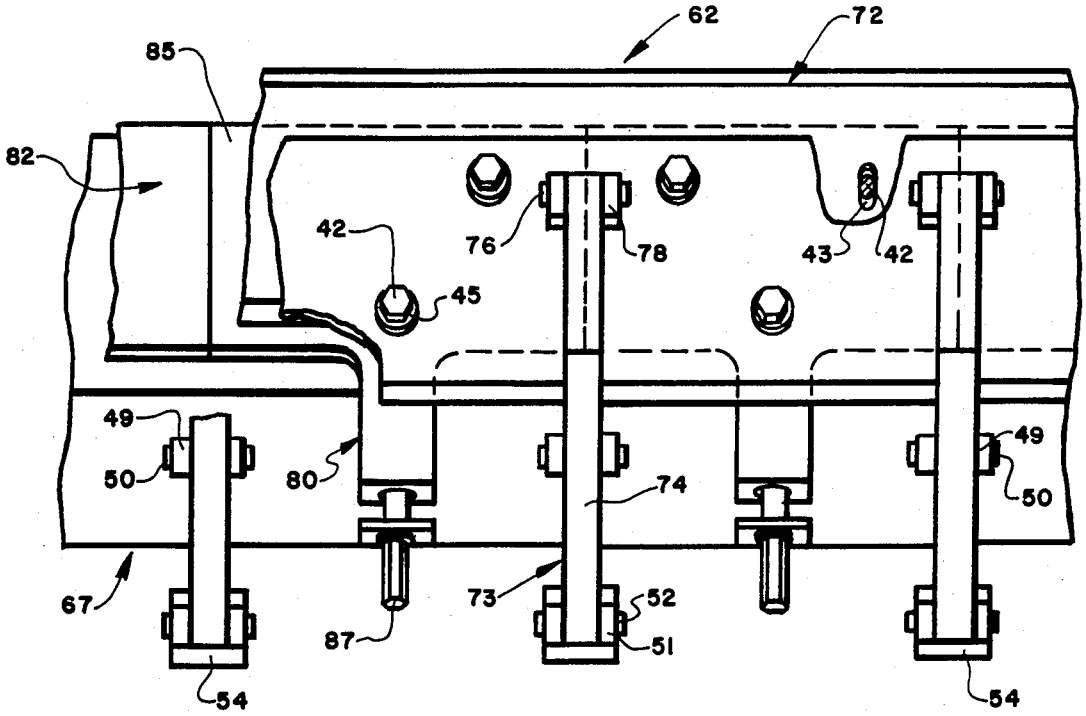
FIG. 7 is a fragmentary plan view with portions broken away, looking in the direction of arrows 7—7, FIG. 4.

A first embodiment of the improved coating nozzle construction is indicated generally at 1, and is shown particularly in FIGS. 1, 2 and 3. Nozzle 1 is shown in a coating position adjacent a moving web 2 which is moving about a backup roll 3 in a usual coating position. Roll 3 is rotatably mounted by a bearing 4 which is supported by a frame 5. A coating collection box 6 also may be located adjacent roll 3.

Nozzle 1 includes a frame, only one end portion 7 being shown, which is pivotally mounted at 8 to a bracket 9 extending outwardly from roll mounting frame 5. Frame 7 which has a bellcrank configuration is pivotally connected at 11 to piston rod 12.

The angle of impingement of nozzle 1 is adjustable by mounting the improved nozzle body which is indicated generally at 15, on frame 7 by means of a curved slot 16 and adjustment clamping bolts 17. Nozzle body 15 is shown in FIGS. 1 and 2, and includes a rigid boxlike first section indicated generally at 13 and a pivotally mounted second section indicated generally at 14. Section 13 has a generally flattened nearly closed U-shaped configuration in cross section. Body section 13 is formed by a pair of spaced converging nozzle body walls 18 and 19 which are integrally joined by a curved rear wall portion 20 and end walls 6, only one of which is shown in the drawings. Nozzle body walls 18, 19, 20 and 6 form an interior combined plenum and fluid distribution chamber 22 which is connected to a fluid supply line 23 which supplies fluid into chamber 22 in a usual manner. The fluid supplied through supply lines 23 usually will be air although other types of fluid may be used for certain coating applications.

A pair of lips indicated generally at 25 and 26 are slidably adjustably mounted on nozzle body wall 18 and on a movable support plate 41, respectively. Lips 25 and 26 are formed with parallel flat surfaces and outer tapered ends 27 and 28. They are shaped alike, but lip 25 contains slotted holes 36 allowing movement of the lip toward and away from the discharge opening, while lip 26 contains tapped holes 44 to receive bolts 42. Movable plate 41 contains slotted holes 43 allowing similar movement of lip 26 relative to plate 41. Nozzle wall 18 contains tapped holes to receive bolts 37 to securely clamp lid 25 in an adjusted position thereon. Thus, both lips are adjustably mounted preferably as part of the installation procedure allowing them to be set with the desired discharge opening.

Surfaces 33 and 34 are machined in walls 18 and 19, respectively, of section 13 to allow clamping of lip plate 30 against surface 33 by bolts 37, and of lip plate 31 by the action through plate 41, against surface 34. Thus, lip 25 is adjusted easily on the nozzle wall 18 by loosening bolts 37 and sliding lip plate 30 transversely along slide surface 33 a desired distance after which bolts 37 clamp the adjusted lip plate in position.

Plate 31 of lip 26 is adjustably mounted on a support plate 41 by a plurality of bolts 42. Bolts 42 extend through slots 43 formed in plate 41 and the threaded ends thereof are engaged in threaded holes 44 formed in lip plate 31. Intervening washers 45 preferably are mounted between the heads of bolts 37 and 42 and the outer surface of plates 30 and 41. Support plate 41 preferably extends transversely throughout the length of nozzle wall 19 shown in fragmentary elevational view in FIG. 3, or may be segmented.

In accordance with another feature of the invention, second nozzle body section 14 which includes support plate 41 together with attached adjustably mounted lip 26 is pivotally mounted with respect to nozzle body wall 19 of the rigid boxlike first section 13 by a plurality of spaced lever assemblies, indicated generally at 47. Each lever assembly 47 includes a lever 48 pivotally mounted by a pivot bracket 49 and pin 50 on the outer surface of nozzle wall 19. Levers 48 are pivotally attached to nozzle body section 13 intermediate the ends thereof with the rear end thereof being connected by clevises 51 and pins 52 to the extended ends of piston rods 53 of pressure actuated cylinders 54. Cylinders 54 are pivotally mounted on the outer ends of brackets 55 which extend outwardly from rear wall 20 of nozzle body section 13. Support plate 41 is attached by bolts 56 (FIG. 3) to the outer ends of levers 48 or may be welded thereto if desired.

Nozzle lips 25 and 26 are slidably adjustably mounted with respect to nozzle body walls 18 and 19 by bolts 37 and 42 until the desired size of discharge opening 29 is achieved. These lip settings will be performed while nozzle 1 is "off line" and not operating. At any time during a coating operation, nozzle body 15 can be pivoted away from backup roll 3 by actuation of cylinders 10 moving nozzle body 15 from the coating position of FIG. 1 to a retracted or cleaning position of FIG. 2. Upon movement of body 15 to the retracted position of FIG. 2, cylinders 54, which are connected to a common fluid supply and control system so as to act in unison, are actuated to move piston rods 53 inwardly into cylinders 54 pivotally moving nozzle lip 26 and plate 41 outwardly away from nozzle lip 25. This retracting movement provides a sufficiently wide fluid discharge opening to enable a cleaning mechanism indicated generally at 57, to be moved into position by arms 58. A plurality of power driven cleaning brushes 59 and 60 then will clean the inner and outer surfaces of lip ends 27 and 28.

In accordance with one of the main features of the invention, first nozzle body section 13 includes mating surface 34 and another mating surface **31*a* is formed on lip plate 31 of second nozzle body section 14. After retraction of cleaning mechanism 57, cylinders 54 are reactuated, pivotally moving levers 48 to bring mating surface 31*a* of lip plate 31 back into abutment with mating surface 34 of nozzle wall 19, repositioning nozzle lip 26 at the same position it had occupied with respect to nozzle lip 25** prior to being moved away for cleaning, without requiring any realignment or readjustment.

Furthermore, the more flexible body section 14 is firmly clamped against the extremely rigid boxlike structure of body section 13 which is relatively uneffected by beam sag, temperature changes, etc. as is section 14. Thus mating surface 34 of section 13 provides an extremely strong and stable area for absorbing the clamping pressure exerted by mating surface **31*a* of lip 26** which enables the amount of lip deflection to be accurately controlled throughout the transverse length of the nozzle body.

Second Embodiment

A modified form of the invention is indicated generally at 62, and is shown particularly in FIGS. 4–7. Embodiment 62 includes a nozzle body indicated generally at 63, which is adjustably mounted on nozzle frame 7 by means of slots 16 and adjustment bolts 17 as discussed above with respect to nozzle body 15. Nozzle body 63 includes a rigid boxlike first section **63*a* and a more flexible pivotally mounted second section 63*b* similar to body sections 13 and 14 of nozzle construction 1. Section 63*a* includes converging walls 64 and 65 which define an interior fluid pressure equalizing chamber 66 and a main hollow member 7 which forms the fluid inlet distribution chamber 67*a* that communicates with fluid supply line 23. Member 67 and converging body walls 64 and 65 are enclosed by end walls 68*a* to form the rigid boxlike configuration of section 63*a*. Wall 68 of member 67 forms the rear wall of equalizing chamber 66 and is formed with a plurality of holes 61 for passage of fluid from chamber 67*a* into chamber 66**.

A v-shaped perforated stiffening wall 69 is mounted between converging walls 64 and 65 separating pressure equalizing chamber 66 from plenum 70. Wall 69 is provided with a plurality of holes **69*a* through which fluid is discharged from chamber 66 into plenum 70. These holes 69*a* are preferably located so that the stream of fluid discharge therefrom is directed toward a wall or walls of plenum 70, rather than toward the discharge opening 90. This insures that such flow is diffused into static pressure in the plenum 70, prior to discharge from nozzle 90. Wall 69 is reinforced by a plurality of reinforcing brackets 91 welded to the inside surfaces of converging nozzle walls 64 and 65 and partition wall 69 at spaced locations along the nozzle (FIG. 6**).

As with embodiment 1, a pair of nozzle lips indicated generally at 71 and 72, are slidably adjustably mounted with respect to nozzle walls 64 and 65, respectively. Nozzle lips 71 and 72 are similar to lips 25 and 26 and therefore are not described in further detail. The pivotally mounted second body section **63*b* includes nozzle lip 72 which is pivotally mounted with respect to nozzle wall 65 as was nozzle lip 26 by a lever assembly indicated generally at 73. Assembly 73 is similar to lever assembly 47 of embodiment 1 except that support plate 41 is pivotally mounted on the extended end of lever 74 and not rigidly attached as is plate 41 of embodiment 1 thereby allowing the mating clamping surface 72*a* of nozzle lip 72 to adjust itself angularly to conform with the angle of the mating clamping surface 85 of wedge 82, whatever the adjusted position of said wedge or against the mating clamping surface 84 of converging wall 65 if wedge 82 is not being used. The extended lever end is formed with an arcuate-shaped slot 75 into which a guide pin 77 projects. Pin 77 is mounted on and extends outwardly from a pivot bracket 78 which is attached to the top surface of plate 41 and is pivotally connected to the lever end by a pivot pin 76**.

In accordance with a further feature of the invention an "on line" adjustment mechanism indicated generally at 80, is mounted on nozzle body 63. Adjustment mechanism 80 includes one or more-wedge blocks 82 which are slidably abuttingly engaged with each other and engageable between outer mating surface 84 of nozzle body wall 65 and inner mating surface **72*a* of nozzle lip 72. Mechanism 80 permits adjustment of nozzle lip 72 with respect to lip 71** while the coating mechanism is "on line" and operating without requiring shutdown of the coating line and retraction of the nozzle body for manual adjustments of the lips as heretofore required.

Each block 82 has a flat inner surface 83 which is slidably engaged with the complementary-shaped outer surface 84 of nozzle body wall 65. Each block 82 further includes an outer angled surface 85 which is slidably engaged with inner mating clamping surface **72*a* of lip 72 which is similar to lip 26 of embodiment 1. Blocks 82 are slidably moved between nozzle wall 65 and nozzle lip 72 by adjustment screws 87 which are mounted on nozzle member 67 by brackets 81. Each adjustment screw 87 has a threaded shaft 88 engaged within a threaded opening 89 formed in wedge block 82. Wedge blocks 82 are individually controlled by adjustment screws 87** which enables a uniform discharge opening to be achieved throughout the nozzle length compensating for minor deflections in the nozzle lips in addition to adjusting the size of the discharge opening to achieve a more accurately controlled coating on the moving web.

Modified nozzle 62 is similar in operation to nozzle 1 in that nozzle lips 71 and 72 are manually adjustably mounted with respect to each other to obtain the desired size for fluid discharge opening 90 except that wedge blocks 82 also determine initially the size of discharge opening 90 by their position between nozzle wall 65 and nozzle lip 72. However, modified nozzle 62 provides the important feature of enabling adjustment of the discharge opening 90 while nozzle 62 is "on line" in a coating machine. Rotation of adjustment screw 87 will advance or retract a wedge 82 thereby opening or closing discharge opening 90 depending upon its direction of movement which is easily seen in FIG. 4. Nozzle 62 also has the opening feature of nozzle 1 in that actuation of cylinders 54 will operate lever assemblies 73 of pivotally mounted body section **63*b* moving lip 72 and plate 41 from the coating position of FIG. 4 to the fully opened cleaning position of FIG. 5 enabling the cleaning mechanism 57 to be engaged with nozzle lips 71 and 72 without disturbing the setting of adjustment blocks 82. Also, upon retraction of cleaning mechanism 57, lever assemblies 73 return nozzle lip 72 to its prior setting with respect to lip 71 and in clamping engagement with wedge blocks 82** without requiring any readjustment of the discharge opening settings.

Nozzle 1 depicts the simplest form of the invention. The basic design of this nozzle is typical of most of the air knives on the market, embracing a combined plenum and distribution chamber fed from one or both ends. Such air knives have various means of adjusting the lips forming the discharge opening, the simplest of which is bolts passing through slotted holes, but such nozzle designs now on the market do not open for cleaning, do not support the inside face of the lip, and do not address the problem of deflection due to internal pressure. For greater stiffness, the basic chambered design of nozzle 62, without the wedge blocks 82, may be substituted for the "U" shaped design of nozzle 1, thereby also improving the evenness of air distribution across the face of the nozzle.

Third Embodiment

A further modified form of the invention is indicated generally at 100 and is shown in FIGS. 8 and 9. Nozzle 100 is similar in most respects to nozzle 62 described above except that wedge blocks 82 are replaced by a single wedge block 109 which is slidably mounted between nozzle wall 65 and lip 72 by a linkage assembly indicated generally at 101. Linkage assembly 101 includes a main actuating link 102 connected to fine adjustment mechanism 93, and a plurality of secondary links 103 which are spaced along the length of the nozzle.

Adjustment mechanism 93 is attached to distribution chamber housing 67 at one end of the nozzle body with main link 102 having a triangular configuration as shown in FIG. 9. One corner of main link 102 is pivotally mounted on the nozzle body by a pivot bolt 104, with a second corner being pivotally attached by a pivot bolt 105 to a projection 106 formed integrally with or mounted on the rear edge of wedge block 109. The third corner of triangular link 102 is connected by a pivot pin 107 to double-ended clevis 108 pivotally mounted on a flattened end of a threaded shaft 94 of adjustment mechanism 93. Shaft 94 extends through the smooth bore of a mounting block 95 which is shown in section. Its position is set by turning two threaded nuts 96 located on the sides of block 95. Secondary links 103 are pivotally mounted by shouldered pivot bolts 110 to nozzle body member 67 and at their other ends by shouldered pivot blocks 111 in projections 112 formed on wedge block 109.

In this modified arrangement nozzle discharge opening 90 can be adjusted uniformly across the length of the nozzle on line by a single manual adjustment of mechanism 93. Inward or outward movement of nuts 96 on threaded shaft portion 94 will pivot main link 102 on bolt 104, and correspondingly will pivot links 103 on bolts 110 to move wedge block 109 along the swing curve of links 102–103 to drive the wedge 109 toward discharge opening 90 to increase the discharge opening or away from said discharge opening to decrease the same, thus changing the final position of lip 72 relative to lip 71, when the nozzle is closed.

Fourth Embodiment

Still another modified form of the improved nozzle is indicated generally at 115 and is shown in FIGS. 10 and 11. Nozzle 115 is similar in most respects to nozzle 100 and includes a wedge block 109A which is generally similar to wedge block 109 and which lies between nozzle wall 65 and nozzle lip 72. A plurality of pins 116 are mounted in the outer surface 84 of nozzle body wall 65 and extend into angled slots 117 formed in wedge blocks 109A. Pins 116 and angled slots 117 are spaced along and throughout the length of the nozzle wall 65 and wedge block 109A.

Adjustment mechanism 121, which is generally similar to adjustment mechanism 93, is attached to wedge block 109 by a pin 118. Pin 118 is attached to the end of threaded shaft 123, and projects into a vertically extending slot 119 formed in wedge block 109A. Advancement or retraction of threaded shaft 123 by adjustment nuts 124 causes wedge block 109A to slide along wall surface 84 of nozzle wall 65 along the line of slots 117 to provide a fine adjustment for nozzle opening 90. This movement of adjustment mechanism 121 drives wedge block 109A toward or away from the discharge opening thus adjusting said discharge opening.

Fifth Embodiment

Figure 14:
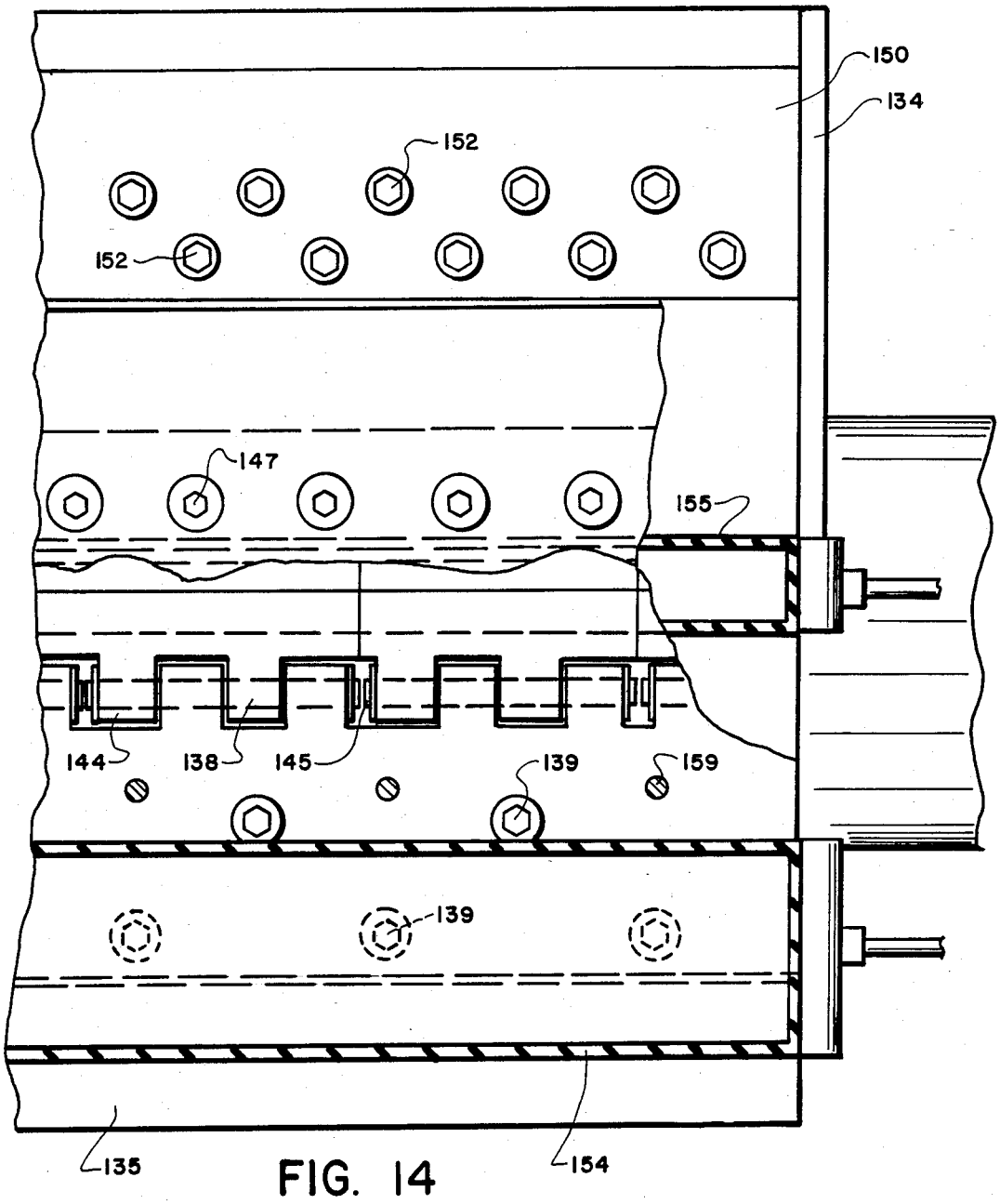
FIG. 14 is a fragmentary sectional view with portions broken away, taken on line 14—14, FIG. 13.

Another embodiment of the improved nozzle construction is indicated generally at 125, and is shown in FIGS. 12, 13 and 14. Nozzle 125 includes a rigid first section **125*a* and a pivotally mounted second section 125*b***.

First section **125*a* includes a generally circular-shaped member 126 having a fluid inlet distribution pressure chamber 127 which is connected to a source of pressurized fluid by usual supply means. A pair of converging walls 128 and 129 are rigidly attached to nozzle body 126 and are enclosed by a pair of end walls 134. A perforated stiffening wall 130 is mounted between walls 128 and 129 and separates the area therebetween into pressure equalizing chamber 66 and plenum 70 as described above for nozzle embodiment 62 and shown in FIG. 4. A nozzle lip 131 similar to lips 25 and 71 is slidably adjustably mounted by bolts 132 on a machined slide surface 133 of wall 128**.

In the pivotally mounted second section **125*b* lever assemblies 47 and 73 have been replaced by a modified pivot assembly. A plate 135 is rigidly connected to body 126 and extends throughout the longitudinal length of the body and is reinforced by a second plate member 136. A plurality of half-sections 138 of a piano type hinge indicated generally at 137, are attached by a plurality of bolts 139 to a machined surface 140 of attachment plate 135. A longitudinally extending key 142 is formed integrally on piano hinge section 138 and is seated within a channel 143 machined in surface 140 of attachment plate 135 to provide accurate placement and alignment of hinge 137 thereon. A plurality of other half-sections 144 of hinge 137 are connected to hinge sections 138 by a plurality of hinge pins 145 and are secured to a slide plate 146 by a plurality of longitudinally spaced bolts 147. Hinge pins 145 have a common centerline and are dispensed across the transverse length of the nozzle body. A key 148 also is formed on slide plate 146 for engagement in a channel 149 machined in hinge section 144** to provide accurate mounting and alignment of the hinge and attached components on the nozzle body.

A second nozzle lip 150 is slidably adjustably mounted on a machined slide surface 151 formed on the extended end of support plate 146 by bolts 152 in a similar manner as are nozzle lips 26 and 72 described above.

For ease in manufacture, hinge 137 is not made from continuous strips but rather is precision made in sections approximately 4 inches long, each having at least three shear points on the hinge pin. Thus, the location of support plate 146 and lip 150 relative to the nozzle body is fixed and controlled at closely spaced intervals less than 1 and ½ inches apart across the length of the nozzle.

In accordance with one of the main features of the invention converging body wall 129 is provided with a mating clamping surface 153 which clampingly engages mating clamping surface 158 formed on slide plate 146 of the pivotally mounted second body section **125*b*. Furthermore, mating surfaces 153 and 158 are located between hinge 137** and the nozzle discharge opening and are closer to the discharge opening than to the hinge.

Another important feature of nozzle 125 is the use of a pair of inflatable tubes 154 and 155 in place of the above described fluid pressure cylinders and lever assemblies for moving nozzle lip 150 and support plate 146 between open and closed positions and for bringing mating surfaces 153 and 158 into abutting pressure engagement with each other when the nozzle is in the coating position of FIG. 12. Tube 155 shown in deflated position in FIG. 12, is mounted between and engaged with hinge section 144 and an abutment block 156 which is mounted on nozzle body 126 and when inflated as shown in FIG. 13, moves lip 150 into the open position or retracted cleaning position. Tube 154 is mounted between and engageable with hinge section 138 and a ramp-shaped abutment block 157 which is attached to support plate 146. When in an inflated position as shown in FIG. 12, tube 154 moves support plate 146 and nozzle lip 150 into the closed or clamped position.

A stop screw 159 is adjustably mounted within a threaded hole 160 formed in support plate 146 and engages hinge section 138 to limit the movement of plate 146 when moving from closed to open position upon inflation of tube 155. Tubes 154 and 155 are air or hydraulic actuated members formed of an expandable elastomer material of the type sold by Merriman Products, Inc. of Jackson, Michigan under the trademark Merriman Windjammer, and are adapted to be connected to a source of pressurized fluid by fluid supply lines 161 as shown in FIG. 14.

The operation of nozzle body 125 is similar in many respects to the various nozzle embodiments described above in that support plate 146 together with attached nozzle lip 150 is moved between the open retracted position of FIG. 13 and the closed coating position of FIG. 12 by the inflation and deflation of tubes 154 and 155. Partition plate 130 increases further the rigidity of rigid nozzle body section **125*a* by providing an internal reinforcement to converging walls 128 and 129. Plate 130 also provides for the uniform flow distribution of the pressurized fluid which flows from chamber 126 into equalizing chamber 66 through a plurality of inlet holes 163 formed in nozzle body 126. The pressurized fluid within chamber 66 then is discharged into plenum 70 through holes 164 formed in partition 136 as shown by the arrows in FIG. 12. This incoming flow is diffused into static pressure in the plenum prior to discharge through nozzle opening 165 in a similar manner as described above with respect to nozzle embodiment 62**.

The symmetrical arrangement of nozzle walls 128 and 129 the lower part of which form plenum 70 provides for symmetrical air flow into the plenum 70, and since wall 129 is shorter than wall 128 as shown in the drawing, it allows access into the plenum for attachment of partition plate 136 therein, preferably by welding. It also provides easy access of cleaning of the nozzle lips and plenum interior. Thus, modified nozzle embodiment 125 enables the lips and plenum interior to be cleaned easily when support plate 146 and attached nozzle lip 150 are in the retracted position of FIG. 13.

Furthermore, when lip 150 is moved to the closed coating position of FIG. 12 by inflation of tube 154 mating surface 158 of hinge mounted support plate 146 is pressed tightly against the flat mating surface 153 of the rigid fixed structure of first section 125*a* of nozzle body uniformly across the longitudinal length thereof with only a relatively small amount of the surface of lip 150 being exposed to the internal pressure of the plenum which enables the lip deflection to be more accurately controlled than heretofore possible with prior art types of nozzles. Modified nozzle 125 also eliminates outwardly projecting levers or the like which can be subject to damage.

A differential screw adjustment block (not shown) may be used for conveniently and accurately adjusting the setting of nozzle lip 150 on slide plate 146. Such an adjustment block may consist of a pair of blocks having axially aligned threaded openings therein, one of which is mounted on lip 150 and the other on support plate 146. The blocks are connected by two right-hand threads of different pitches which are engaged in the threaded openings. Rotation of the screw will adjust the spacing between the blocks and correspondingly the position of lip 50 on machined surface 133.

Nozzles 1 and 125 depict simplified forms of the invention, which omits the wedge type adjusting mechanisms 62, 109 and 109A. Use of the simplified construction of nozzle 1 may be combined with the partitioned construction of nozzles 62, 100 and 115 as shown in nozzle 125, to secure benefits of greater rigidity and improved fluid flow which such construction provides.

SUMMARY

Accordingly, improved nozzles 1, 62, 100, 115 and 125 provide a nozzle construction in which the nozzle sidewalls are rigidly mounted with respect to each other, yet provides means for opening the nozzle for cleaning by hand or by a cleaning mechanism, without affecting the rigidity and stability of the nozzles. The nozzles enable the nozzle lips to be moved to the cleaning positions quickly, easily and automatically and then be returned to their adjusted position without requiring any readjustment of the nozzle lips with the previously adjusted discharge opening remained unchanged. Another advantage is the ability of nozzle embodiments 62, 100, and 115 to be adjusted while "on line" by one or more adjusting mechanisms located at one or more locations along the longitudinal length of the nozzle body.

Nozzles 1, 62, 100, 115 and 125 enable the nozzle lips to attain maximum rigidity by clamping the major portion of the lip area against the total nozzle structure, but still may be opened for cleaning and then reclosed to the exact fluid discharge opening previously established. If desired, pressure actuated cylinders 54 and inflatable tubes 154 and 155 may be replaced with a cam and spring actuated mechanism to apply closure pressure to the levers without affecting the concept of the invention.

A rigid clamping pressure also is achieved by the use of a plurality of closely spaced pressure actuated levers 47 and 73 located along the nozzle body which effectively fix the relatively flexible movable lip to the more rigid nozzle body at each lever location. This reduces the span between supporting points subject to deflection to the distance between levers. This is extremely important to achieve a uniform nozzle opening due to the flexibility of the lips when subjected to the high fluid pressures within the nozzle body. A preferred spacing of the levers has been found for many applications to be approximately 12 inches. Furthermore, continuous tube 154 provides a uniform clamping pressure throughout the length of the nozzle when used in place of the closely spaced pressure actuated levers.

For example, in nozzle 62, the wedges preferably have a slope of the order of 1 to 8; that is the thickness increases by $\frac{1}{8}$ inch for each inch along the slope. Therefore, if the wedge is driven toward the discharge opening $\frac{1}{4}$ inch the height of the wedge at a given distance increases by 0.03125 inches. Since the distance from pin 50 to the top of the lip 72 does not increase, the discharge opening is widened by 0.03125 inches. This would be the normal maximum range of the change produced in the discharge opening by movement of the wedge.

The included angle between the lip mounting surfaces of the two lips remains the same whether the wedge is used of not. That is, the angle between the fihished surfaces of plate 64 and 65 in nozzles 62, 100, and 115 is reduced from that of nozzle 1 by the angle of the slope of 1 to 8. When the wedges are moved, toward or away from the discharge opening, they move along the plane of plate 54; therefore the upper surface of the wedge rises or falls by $\frac{1}{8}$ the amount of the movement toward or away from the discharge opening, but the included angle between the mounting surface of wall 64 and the top of the wedge has not changed. However, this action does change the location of the intersection of the plane of the top surface of the wedges 82 with the plane of the top surface of plate 65. Therefore, the lip and lip holder assembly is pivoted about pins 76, to allow the assembly to seat itself fully on the top surface of wedge 82, regardless of position of said wedges.

In nozzles 100 and 115, the wedge is moved transversely along the length of the nozzle in order to drive the wedge toward or away from the discharge opening. In nozzle 100 this is achieved by the swing links which are proportioned to give $\frac{1}{4}$ inch motion to and from the discharge opening for 1 inch transverse motion. In nozzle 115, the slots have a slope of $\frac{1}{4}$ inch in 1 inch for the same result.

When moving the wedge 1 inch transversely, all parts of it move to and from the discharge opening by $\frac{1}{4}$ inch. In nozzle 100 the adjusting screw is connected to the wedge by the double clevis 108 to allow this movement without binding since the adjusting screw does not move to and from the discharge opening. In nozzle 115, the pin in the screw rides in slot 119. In neither case does the screw turn. It is moved laterally by turning the nuts 96 and 124.

Accordingly, the improved nozzle construction is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for description purposes and are intended to be broadly construed.

Moreover, the description and illustration of the invention is by way of example, and the scope of the invention is not limited to the exact details shown or described.

Having now described the features, discoveries and principles of the invention, the manner in which the improved nozzle construction for coating equipment is constructed and used, the characteristics of the construction; and the advantageous, new and useful results obtained; the new and useful structures, devices, elements, arrangements, parts, and combinations, are set forth in the appended claims.

What is claimed is:

1. Fluid nozzle construction for coating machines and the like including:

a transversely elongated nozzle body having first and second rigid sections movably mounted with respect to each other and movable between a working position and a cleaning position; said first section having a back wall and first and second converging side walls partially forming a fluid pressure chamber for receiving fluid under pressure from a source, said converging sidewalls being in rigidly fixed position relative to each other; said first wall having a first of a pair of nozzle lips, adjustably rigidly mounted on a forward end thereof, for defining a transversely extending nozzle discharge opening with a second of the nozzle lips when the rigid sections are in the working position; the second side wall having a plurality of pivot supports attached thereto adjacent the back wall, said pivot supports being distributed across the transverse length of the nozzle body first section along a common centerline parallel to the nozzle discharge opening, said centerline being spaced from and non-adjacent to said nozzle discharge opening with said second side wall also including a first mating surface adjacent a forward end thereof and extending across the transverse length of said wall; said second section being pivotally mounted on the pivot supports, said second section having the second of the pair of nozzle lips adjustably rigidly mounted thereon, and a second mating surface extending across the transverse length of said second section and located between the nozzle discharge opening and the pivot supports for clamping engagement with the mating surface of the first section; and pressure means acting on the first and second sections for pivoting the second section about the pivot support for moving said sections between the working and cleaning positions and for clamping the second mating surface against the first mating surface throughout the transverse length thereof for maintaining the nozzle lips in a preset nozzle discharge opening postion by exerting a clamping force in excess of a separating force exerted on the first and second sections of the fluid within the pressure chamber, clamping engagement of the first and second mating surfaces occurring at a location adjacent to the nozzle discharge opening, the clamped mating surfaces being spaced from the common centerline of the pivot supports.

2. The nozzle construction defined in claim 1 in which the rigid first section of the nozzle body has a generally compressed U-shaped configuration in cross section.

3. The nozzle construction defined in claim 1 in which the converging walls of the first section form a fluid distribution chamber and a plenum separated by a partition wall; and in which a plurality of openings are formed in the partition wall to permit flow of fluid from the distribution chamber and into the plenum for discharge through the nozzle discharge opening.

4. The nozzle construction defined in claim 1 in which wedge means is movably mounted between the second lip and the second converging wall of the first section for adjusting the size of the fluid discharge opening while the nozzle is in working position in a coating line.

5. The nozzle construction defined in claim 4 in which the wedge means includes a plurality of wedge blocks placed transversely along said second converging wall; and in which a plurality of screw means are engaged with the wedge blocks for individually moving the wedge blocks along said second converging wall to adjust the size of the fluid discharge opening.

6. The nozzle construction defined in claim 5 in which each of the screw means is manually individually adjusted for moving individual wedge blocks to maintain a uniform fluid discharge opening throughout the length of the nozzle body.

7. The nozzle construction defined in claim 4 in which the wedge means includes a wedge block having a smooth flat surface slidably engaged with the second converging wall, and an inclined surface sloping downwardly toward the said flat surface; in which screw means is engaged with the wedge block for moving said wedge block along said second converging wall; and in which the inclined surface of the wedge block is engaged with the second lip for moving said second lip with respect to the first lip as the wedge block is moved by the screw means along said second converging wall.

8. The nozzle construction defined in claim 7 in which the second section includes plate means for adjustably mounting the second lip on said second section; in which the pressure means includes a plurality of levers pivotally mounted on the first section of the nozzle body and engageable with the plate means, and pressure actuated cylinders for moving said levers; and in which the plate means is pivotally mounted on extended ends of the levers enabling the second lip to align with the inclined surface of the wedge block as said block is slidably adjusted with respect to said second converging wall.

9. The nozzle construction defined in claim 8 in which the levers are closely spaced along and mounted on said second converging wall and connected at spaced intervals to the plate means; and in which the levers are spaced approximately 12 inches apart.

10. The nozzle construction defined in claim 4 in which pin means is mounted on said second converging wall and extends into slot means formed in the wedge means to movably mount the wedge means on said second wall.

11. The nozzle construction defined in claim 10 in which adjustment means is connected to the wedge means for moving said wedge means along said second converging wall to adjust the size of the fluid discharge opening.

12. The nozzle construction defined in claim 11 in which the adjustment means includes a threaded shaft pivotally connected to the wedge means and an internally threaded member operatively engaged with said shaft and fixed with respect to the nozzle body.

13. The nozzle construction defined in claim 4 in which the wedge means is movably mounted on the first section of the nozzle body by a plurality of links; and in which adjustment means is pivotally connected to one of said links for moving the wedge means along said second converging wall to change its position with respect to the discharge opening.

14. The nozzle construction defined in claim 13 in which one of the links has a generally triangular configuration with one corner of the link being pivotally connected to the nozzle body, with a second corner being pivotally connected to the wedge means, and with a third corner being pivotally connected to the adjustment means; and in which the adjustment includes a threaded shaft movably mounted on the first section of the nozzle body by an internally threaded member attached to said first section

15. The nozzle construction defined in claim 1 in which the pressure means is a pair of fluid pressure actuated tubes extending continuously across the transverse length of the nozzle body.

16. The nozzle construction defined in claim 1 in which the pivots supports are a series of hinge pins located on the common centerline and disposed across the transverse length of the first section.

17. The nozzle construction defined in claim 16 in which the mating surfaces are located between the hinge means and the discharge opening and are closer to said discharge opening than said hinge means.

18. The nozzle construction defined in claim 16 in which adjustment stop means is mounted on the second section and is engageable with the first section for controlling the pivotal movement of the second section.

19. The nozzle construction defined in claim 1 in which one of the converging nozzle body walls has a greater length than the other of said other converging nozzle body walls.

20. The nozzle construction defined in claim 1 in which the first section of the nozzle body includes partition means forming transversely extending distribution chamber means spaced rearwardly from the discharge opening and extending transversely a distance at least equal to the length of said discharge opening; plenum means formed by the converging body walls and the partition means between said distribution chamber means and said discharge opening for discharging fluid through said discharge opening; restricted opening means formed in said partition means for directing the fluid into said plenum means rearwardly of said discharge opening and toward the converging body walls, said restricted opening means communicating between the distribution chamber means and the plenum means for passing fluid from said distribution chamber means to said plenum means; and means for supplying the fluid to the distribution chamber means.

21. The nozzle construction defined in claim 1 in which partitions are mounted on and extend the first and second converging side walls within the first section for strengthening said walls against deflection and for dividing said first section into separate chambers for distributing and equalizing the fluid pressure across the transverse length of the nozzle and for establishing a plenum behind the nozzle discharge opening; and in which said partitions are formed with holes for transmission of fluid under pressure between the chambers and for breaking up internal velocity flow patterns of the fluid.

22. The nozzle construction defined in claim 1 in which the second side wall includes wedge means for adjusting the nozzle discharge opening without disturbing a pre-set working position of the lips.

* * * * *